US006126558A

United States Patent [19]

Higuchi et al.

[11] Patent Number: 6,126,558

[45] Date of Patent: Oct. 3, 2000

[54] MULTI-PIECE SOLID GOLF BALL

[75] Inventors: Hiroshi Higuchi; Yasushi Ichikawa; Hisashi Yamagishi, all of Chichibu, Japan

[73] Assignee: Bridgestone Sports Co., Ltd., Tokyo, Japan

[21] Appl. No.: 09/268,654

[22] Filed: Mar. 16, 1999

[30] Foreign Application Priority Data

Mar. 16, 1998 [JP] Japan ..... 10-085026

[51] Int. Cl.[7] ..... A63B 37/06

[52] U.S. Cl. ..... 473/374

[58] Field of Search ..... 473/351, 374, 473/376

[56] References Cited

U.S. PATENT DOCUMENTS

| | | | |
|---|---|---|---|
| 5,184,828 | 2/1993 | Kim et al. | 473/374 |
| 5,704,854 | 1/1998 | Higuchi et al. | 473/374 X |
| 5,730,664 | 3/1998 | Asakura et al. | 473/374 X |
| 5,820,487 | 10/1998 | Nakamura et al. | 473/374 |
| 5,830,085 | 11/1998 | Higuchi et al. | 473/374 X |
| 5,899,822 | 5/1999 | Yamagishi et al. | 473/374 |
| 5,957,784 | 9/1999 | Asakura et al. | 473/374 |
| 5,967,907 | 10/1999 | Takemura et al. | 473/374 X |
| 5,967,908 | 10/1999 | Yamagishi et al. | 473/374 X |
| 5,980,396 | 11/1999 | Moriyama et al. | 473/376 |

FOREIGN PATENT DOCUMENTS

| | | |
|---|---|---|
| 2316878A | 3/1998 | United Kingdom . |
| 2320440A | 6/1998 | United Kingdom . |

OTHER PUBLICATIONS

United Kingdom Search Report.

*Primary Examiner*—John A. Ricci
*Attorney, Agent, or Firm*—Sughrue, Mion, Zinn, Macpeak & Seas, PLLC

[57] ABSTRACT

In a multi-piece solid golf ball comprising a solid core, an intermediate layer, and a cover, the core at its surface has a Shore D hardness Hs of less than 55, the intermediate layer has a Shore D hardness Hm, and the cover has a Shore D hardness Hc, which satisfy $1.0<Hm/Hs<1.4$ and $1.0<Hc/Hm<2.0$. The intermediate layer is formed mainly of a polyurethane resin, and the cover is formed mainly of an ionomer resin. The ball has satisfactory distance coverage, durability, and soft feel, and is improved in spin properties.

20 Claims, No Drawings

MULTI-PIECE SOLID GOLF BALL

BACKGROUND OF THE INVENTION

1. Field of the Invention

This invention relates to a multi-piece solid golf ball comprising a solid core, an intermediate layer and a cover. More particularly it relates to a multi-piece solid golf ball in which the overall hardness distribution of the ball is optimized to provide satisfactory all-round performance including flight performance, durability, feel, and control.

2. Prior Art

Golf balls having a variety of constructions are available on the market. Of these, the majority of golf balls now on the market are two-piece solid golf balls having a rubber-based core enclosed within a cover made of ionomer resin or the like, and thread-wound golf balls comprising a solid or liquid center about which is wound a rubber thread which is in turn enclosed within a cover.

Most golfers of ordinary skill use two-piece solid golf balls because of their excellent flight performance and durability. However, the two-piece solid golf balls have a very hard feel when hit, and are difficult to control because of the rapid separation of the ball from the head of the club. For this reason and others, many professional golfers and low-handicap golfers prefer thread-wound golf balls to two-piece solid golf balls. Although thread-wound golf balls have a superior feel and controllability, their flight distance and durability fall short of those for two-piece solid golf balls.

Since two-piece solid golf balls and thread-wound golf balls provide mutually opposing features, golfers select which type of ball to use based on their level of skill and personal preference.

This situation has prompted efforts to approximate the feel of a thread-wound golf ball in a solid golf ball. As a result, a number of soft, two-piece solid golf balls have been proposed. A soft core is used to obtain such soft two-piece solid golf balls, but making the core softer lowers the resilience of the golf ball, compromises flight performance, and also markedly reduces durability. As a result, not only do these balls lack the excellent flight performance and durability characteristic of ordinary two-piece solid golf balls, but they are often in fact unfit for actual use. More specifically, the structure of prior art two-piece solid golf balls is determined depending on which of the four features of softness, resilience, spin and durability is of more importance. Any attempt to improve one of these features compromises the remaining features.

As a matter of course, controllability is also necessary upon full shots with a wood, typically a driver or a long iron. If a soft cover is used in a ball because too much attention is paid to the purpose of improving the spin properties upon control shots or approach shots with a short iron, the ball would receive a too great a spin rate upon a shot with a driver (which causes greater deformation) and sky or rise too high, resulting in a reduced carry. By contrast, if the ball receives a too small a spin rate, the ball will prematurely drop in its fall trajectory, which is also detrimental to the ultimate carry. This means that an appropriate spin rate is necessary upon driver shots too.

SUMMARY OF THE INVENTION

An object of the present invention is to provide a multi-piece solid golf ball comprising a solid core, an intermediate layer and a cover in which the overall hardness distribution of the ball is optimized to satisfy the requirements of flight performance, durability, feel, and control at the same time.

The inventors have found that a multi-piece solid golf ball of the multilayer structure comprising a solid core of at least one layer, an intermediate layer and a cover is given an optimum hardness distribution when the surface hardness of the core is less than 55 in Shore D hardness, the hardness of the intermediate layer is higher than the surface hardness of the core, the hardness of the cover is higher than the hardness of the intermediate layer, and the intermediate layer is formed mainly of a polyurethane resin. The golf ball exerts satisfactory all-round performance covering flight performance, durability, feel, and control.

Specifically, the invention provides a multi-piece solid golf ball comprising a solid core, an intermediate layer, and a cover. The core at its surface has a Shore D hardness Hs of less than 55, the intermediate layer has a Shore D hardness Hm, and the cover has a Shore D hardness Hc. The ratio in Shore D hardness of the intermediate layer to the core surface, Hm/Hs, is from more than 1.0 to less than 1.4. The ratio in Shore D hardness of the cover to the intermediate layer, Hc/Hm, is from more than 1.0 to less than 2.0. The intermediate layer is formed mainly of a polyurethane resin.

Since the soft core is enclosed within the harder intermediate layer which is, in turn, enclosed within the harder cover, the ball as a whole is given an optimum hardness distribution, which is effective for minimizing the energy loss associated with excessive deformation upon impact and maintains appropriate resilience. Then the ball is improved in distance and durability. In particular, the spin rate upon a full shot with a driver is optimized, contributing to a drastic increase of carry. The ball is also improved in control and feel. Because the spin is retained more due to the increased moment of inertia, the ball is improved in straight forward travel and control upon any of driver, iron and putter shots.

DETAILED DESCRIPTION OF THE INVENTION

The multi-piece solid golf ball of the invention includes a solid core, an intermediate layer which is harder than the core surface, and a cover which is harder than the intermediate layer.

The solid core may be formed of a rubber composition. The rubber composition used herein is not critical and may be any of compositions comprising a base rubber, crosslinking agent, co-crosslinking agent, inert filler and other additives, as used in conventional solid cores. The base rubber may be natural or synthetic rubber commonly used in solid golf balls although cis-1,4-polybutadiene containing at least 40% of cis-structure is especially preferable. Another rubber component such as natural rubber, polyisoprene rubber or styrene-butadiene rubber may be blended with the polybutadiene rubber as desired. The crosslinking agent is exemplified by organic peroxides such as dicumyl peroxide, di-t-butyl peroxide, and 1,1-bis(t-butylperoxy)-3,3,5-trimethylcyclohexane. Preferably, using a mixture of dicumyl peroxide and 1,1-bis(t-butylperoxy)-3,3,5-trimethylcyclohexane, the rubber is vulcanized at 160° C. for 20 minutes.

The co-crosslinking agent used herein is not critical and may be selected from metal salts of unsaturated fatty acids, for example, zinc and magnesium salts of unsaturated fatty acids of 3 to 8 carbon atoms such as methacrylic acid and acrylic acid. Zinc acrylate is especially preferred. The co-crosslinking agent is used in an appropriate amount, preferably about 7 to 45 parts by weight per 100 parts by weight of the base rubber. The inert filler includes zinc oxide, barium sulfate, silica, calcium carbonate, and zinc carbonate, with the zinc oxide and barium sulfate being often used. The amount of the inert filler blended varies with the specific gravity of the core and cover, the weight standard of the ball and other factors, although an appropriate amount is up to about 40 parts by weight per 100 parts by weight of the base rubber. By properly selecting the amounts of the crosslinking agent and filler (such as zinc oxide or barium sulfate), the hardness and weight of the entire core can be adjusted optimum.

From the core-forming composition obtained by blending the above-mentioned components, a solid core having the desired hardness distribution according to the invention is prepared. For example, the composition is kneaded in a conventional mixer such as a Banbury mixer or roll mill, compression or injection molded in a mold, and heat cured under appropriate temperature conditions as mentioned above.

According to the invention, the solid core should have a surface hardness (Hs) of less than 55 in Shore D hardness. The surface hardness of the core is preferably from 20 to 53, more preferably from 25 to 50 in Shore D hardness. With a Shore D hardness of 55 or higher, the feel of the ball when hit becomes undesirably hard. If the core is too soft, the ball would experience a greater deformation upon impact, resulting in a reduced carry due to an increased energy loss and exacerbating durability.

The solid core preferably has a diameter of 32 to 41 mm, and more preferably 34 to 39 mm. The hardness, weight, specific gravity and other parameters of the entire core are not critical and may be determined as appropriate insofar as the objects of the invention are attained. Often preferably, the core in its entirety has a hardness corresponding to a deflection of 2.3 to 6.5 mm, especially 2.5 to 5.5 mm under an applied load of 100 kg, and a weight of 25 to 42 grams, especially 27 to 41 grams. The core preferably has a specific gravity of less than 1.3, more preferably 1.0 to 1.28, further preferably 1.05 to 1.25.

Most often, the core is formed to a one-piece structure consisting of a single layer although it may be formed to a multilayer structure of two or more layers if desired.

In the golf ball of the invention, the intermediate layer is formed mainly of a polyurethane resin. Thermoplastic polyurethane elastomers are appropriate as the polyurethane resin.

The thermoplastic polyurethane elastomer has a molecular structure including soft segments of a high molecular weight polyol, hard segments constructed of a monomolecular chain extender, and a diisocyanate.

The high molecular weight polyol compound is not critical and may be any of polyester polyols, polyol polyols, copolyester polyols, polycarbonate polyols and polyether polyols. The polyester polyols include polycaprolactone glycol, poly(ethylene-1,4-adipate) glycol, and poly (butylene-1,4-adipate) glycol. Typical of the copolyester polyols is poly(diethylene glycol adipate) glycol. One exemplary polycarbonate polyol is hexane diol-1,6-carbonate glycol. Polyoxytetramethylene glycol is typical of the polyether polyols. These polyols have a number average molecular weight of about 600 to 5,000, preferably about 1,000 to 3,000.

The diisocyanates used herein include hexamethylene diisocyanate (HDI), tolylene diisocyanate (TDI), diphenylmethane diisocyanate (MDI), hydrogenated MDI ($H_{12}$MDI), IPDI, CHDI, and derivatives thereof.

The chain extender used herein is not critical and may be any of commonly used polyhydric alcohols and amines. Examples include 1,4-butylene glycol, 1,2-ethylene glycol, 1,3-propylene glycol, 1,6-hexylene glycol, 1,3-butylene glycol, dicyclohexylmethane diamine (hydrogenated MDA), and isophorone diamine (IPDA).

The intermediate layer according to the invention is formed mainly of the polyurethane resin, especially thermoplastic polyurethane elastomer, with which another thermoplastic resin may be blended if desired for enhancing the effect and benefits of the invention. Examples of the other thermoplastic resin which can be blended include polyamide elastomers, polyester elastomers, ionomer resins, styrene block elastomers, hydrogenated polybutadiene, ethylene-vinyl acetate (EVA) copolymers, polycarbonates, polyacrylates, and polyamides.

According to the invention, the intermediate layer is preferably formed to a Shore D hardness (Hm) of 20 to 55, more preferably 22 to 54, most preferably 27 to 52, within which a soft feel is ensured. With a Shore D hardness of less than 20, the ball would become less resilient or less durable. A Shore D hardness of more than 55 would adversely affect the feel of the ball when hit and its resilience.

The intermediate layer is formed to a hardness higher than the surface hardness of the solid core. Specifically, the solid core at the surface has a Shore D hardness Hs and the intermediate layer has a Shore D hardness Hm, which satisfy $1.0<Hm/Hs<1.4$, especially $1.01<Hm/Hs<1.35$. A Hm/Hs ratio equal to or more than 1.4 corresponds to a greater hardness difference, which leads to an increased energy loss upon impact, insufficient resilience and poor durability.

Preferably, the intermediate layer has a specific gravity of at least 1.08, more preferably 1.15 to 2.0, further preferably 1.2 to 1.6, most preferably 1.23 to 1.5. It is further desirable that the specific gravity of the intermediate layer be greater than that of the solid core. More desirably, the specific gravity of the intermediate layer is greater than that of the solid core by at least 0.05, especially 0.08 to 0.15. Then, the moment of inertia of the ball is maintained so large that the attenuation of spin rate of the ball during flight may be minimized. The spin rate acquired immediately after a club shot is retained or slightly attenuated until the ball falls and lands. The ball can maintain stable flight immediately before the ball lands on the ground.

To form the intermediate layer to a specific gravity within the above-defined range, an inorganic filler, especially a filler having a specific gravity of at least 3 may be blended in the polyurethane resin. Exemplary inorganic fillers are metal powder, metal oxides, metal nitrides, and metal carbides. Illustrative examples include tungsten (black, specific gravity 19.3), tungsten carbide (blackish brown, specific gravity 15.8), molybdenum (gray, specific gravity 10.2), lead (gray, specific gravity 11.3), lead oxide (dark gray, specific gravity 9.3), nickel (silvery gray, specific gravity 8.9), copper (reddish brown, specific gravity 8.9), and mixtures thereof. It is preferred to use such high specific gravity fillers although fillers having a relatively low specific gravity such as barium sulfate, titanium dioxide, and zinc white may be used.

The gage or thickness of the intermediate layer may be determined as appropriate although it is preferably 0.2 to 3 mm, more preferably 0.5 to 2.5 mm thick.

Around the intermediate layer, the cover is formed to complete the golf ball of the invention. The cover may be formed mainly of an ionomer resin which is commonly used in conventional solid golf balls. Exemplary cover stocks which can be used herein include Himilan 1605 and 1706 by Du Pont-Mitsui Polychemicals Co., Ltd. and Surlyn 8120 and 8320 by E I. dupont. A combination of two or more ionomer resins may also be used. If desired, the ionomer resin may be blended with well-known additives such as pigments, dispersants, antioxidants, UV-absorbers, UV-stabilizers, and plasticizers.

According to the invention, the cover is preferably formed to a Shore D hardness (Hc) of up to 68, more preferably 45 to 68, further preferably 50 to 67, most preferably 55 to 65. With a cover hardness of less than 45 in Shore D, the ball would become less resilient or more susceptible to spin. A Shore D hardness of more than 68 would adversely affect the durability of the ball and the feel upon putting.

The cover is formed to a hardness higher than the hardness of the intermediate layer. Specifically, the cover has a Shore D hardness Hc and the intermediate layer has a Shore D hardness Hm, which satisfy $1.0<Hc/Hm<2.0$, especially $1.01<Hc/Hm<1.9$. A Hc/Hm ratio equal to or more than 2.0 results in a hard feel upon putting and poor durability. If $Hc \leqq Hm$, the ball becomes more susceptible to spin and less resilient, resulting in a reduced carry.

Preferably the cover has a gage of 0.5 to 3.2 mm, more preferably 1.0 to 2.5 mm, most preferably 1.2 to 2.2 mm. With a cover gage of less than 0.5 mm, the ball would be less durable or less resilient. A cover gage of more than 3.2 mm would adversely affect the feel.

The specific gravity of the cover is preferably from 0.9 to less than 1.2, more preferably 0.92 to 1.18.

The cover may be formed to either a single layer or a multilayer structure of two or more layers.

The gage or thickness of the intermediate layer and the cover combined is preferably at least 2 mm, especially 2.5 to 5.5 mm. If the total gage is less than 2 mm, the durability of the ball against shots can be deteriorated.

In the practice of the invention, an adhesive layer may be interposed between the cover and the intermediate layer because improvements in resilience and durability are expectable. Any of the adhesives which can firmly join the respective layers may be used. For example, epoxy resin adhesives, urethane resin adhesives, vinyl resin adhesives, and rubber adhesives are useful.

Before the adhesive is applied to the intermediate layer, the surface of the intermediate layer may be roughened by a conventional technique. The thickness of the adhesive layer may be selected as appropriate although it is usually about 5 to 300 $\mu$pm, especially about 10 to 100 $\mu$m thick.

Since the intermediate layer is formed of a composition based on the polyurethane thermoplastic elastomer, the composition can be molded over the solid core by compression molding or injection molding.

On the other hand, the cover is formed of a cover stock based on the ionomer resin. The method of enclosing the intermediate layer with the cover is not particularly limited. Most often, a pair of hemispherical cups are preformed from the cover stock, the intermediate layer is wrapped with the pair of cups, and molding is effected under heat and pressure. Alternatively, the cover stock is injection molded over the intermediate layer.

The golf ball in its entirety preferably has a moment of inertia of at least 81 $g \cdot cm^2$, especially 82 to 85 $g \cdot cm^2$. With a moment of inertia of less than 81 $g \cdot cm^2$, the ball would remarkably attenuate its spin rate during flight, failing to provide satisfactory flight properties. The method of determining the moment of inertia is as follows.

Inertia Moment

It is calculated according to the equation shown below. More particularly, the inertia moment is a value calculated from the diameters (gages) and specific gravities of the respective layers and it can be determined from the following equation on the assumption that the ball is spherical. Although the ball is regarded spherical for the calculation purpose, the specific gravity of the cover is lower than the specific gravity of the cover stock itself because the dimples are present on the actual ball. The specific gravity of the cover is herein designated an imaginary cover specific gravity, which is used for the calculation of an inertia moment M.

$$M=(\pi/5880000)\times\{(r1-r2)\times D1^5+(r2-r3)\times D2^5+r3\times D3^5\}$$

M: inertia moment ($g\text{-}cm^2$)

r1: core specific gravity

D1: core diameter r2: intermediate layer specific gravity

D2: intermediate layer diameter (the diameter of a sphere obtained by forming the intermediate layer around the core)

r3: imaginary cover specific gravity

D3: cover diameter (ball diameter)

Note-that the diameters are expressed in mm.

The golf ball of the invention is formed with a multiplicity of dimples in the cover surface. The geometrical arrangement of dimples may be octahedral, icosahedral or the like while the dimple pattern may be selected from square, hexagon, pentagon, and triangle patterns.

While the above construction is met, the solid golf ball of the invention may be formed so as to have a diameter of not less than 42.67 mm and a weight of not greater than 45.93 g in accordance with the Rules of Golf.

The multi-piece solid golf ball of the invention travels a satisfactory carry, has durability and a soft feel, and is improved in spin properties.

EXAMPLE

Examples of the invention are given below by way of illustration and not by way of limitation.

Examples 1–5 & Comparative Examples 1–4

On a solid core of the composition shown in Table 1, the composition shown in Table 2 was injection molded to form an intermediate layer. The cover stock of the composition shown in Table 3 was injection molded thereon to form a cover. In this way, three-piece solid golf balls with parameters shown in Table 4 were fabricated.

The golf balls were examined for flight distance, spin rate, feel, scraping resistance, and consecutive durability by the following tests.

Scraping Resistance

Using the swing robot, the ball was hit at two points with a sand wedge (#SW) at a head speed of 38 m/sec. The ball at the hit points was visually examined.

○: good

Δ: medium

X: poor

Consecutive Durability

Using a flywheel hitting machine, the ball was repeatedly hit at a head speed of 38 m/sec. The ball was evaluated in terms of the number of hits repeated until the ball was broken.

○: good

Δ: medium

X: poor

Flight Distance

Using a swing robot, the ball was hit with a driver (W#1) at a head speed of 45 m/sec to measure a carry and total distance.

Spin Rate

A spin rate was calculated from photographic analysis by photographing the behavior of the ball immediately after impact with W#1 and No. 9 iron (I#9, head speed 36 m/sec.).

Feeling

Three professional golfers actually hit the ball with W#1 and I#9 to examine the ball for feeling according to the following criteria.

○: soft

Δ: somewhat hard

X: hard

The results are shown in Table 4.

TABLE 1

| | Solid core composition (pbw) Example | | | | | Comparative Example | | | |
|---|---|---|---|---|---|---|---|---|---|
| | 1 | 2 | 3 | 4 | 5 | 1 | 2 | 3 | 4 |
| Polybutadiene | 100 | 100 | 100 | 100 | 100 | 100 | 100 | 100 | 100 |
| Dicumyl peroxide | 1.2 | 1.2 | 1.2 | 1.2 | 1.2 | 1.2 | 1.2 | 1.2 | 1.2 |
| Barium sulfate | 13.5 | 17.9 | 13.3 | 19.1 | 20.0 | 18.9 | 21.1 | 12.8 | 20.6 |
| Zinc white | 5 | 5 | 5 | 5 | 5 | 5 | 5 | 5 | 5 |
| Antioxidant | 0.2 | 0.2 | 0.2 | 0.2 | 0.2 | 0.2 | 0.2 | 0.2 | 0.2 |
| Zinc salt of pentachlorothiophenol | 1 | 1 | 1 | 1 | 1 | 1 | 1 | 1 | 1 |
| Zinc acrylate | 17.0 | 26.6 | 28.9 | 11.1 | 22.2 | 33.3 | 25.9 | 34.0 | 34.0 |

Note:
Polybutadiene is BR01 by Nippon Synthetic Rubber K.K.

TABLE 2

| | Intermediate layer composition (pbw) | | | | | | | |
|---|---|---|---|---|---|---|---|---|
| | Shore D | a | b | c | d | e | f | g |
| Pandex T1190 | 40 | 100 | — | — | 100 | — | — | — |
| Pandex T7298 | 50 | — | 100 | 100 | — | — | — | — |
| Hytrel 4047 | 40 | — | — | — | — | — | 100 | — |
| PEBAX 3533 | 42 | — | — | — | — | 100 | — | — |
| Himilan 1706 | 63 | — | — | — | — | — | — | 60 |
| Surlyn 8120 | 45 | — | — | — | — | — | — | 40 |
| Titanium dioxide | — | 6 | — | — | — | — | — | — |
| Tungsten | — | — | — | 7.5 | — | — | — | — |

Note:
Pandex T1190 and T7298 by Dai-Nippon Ink & Chemical Industry K.K.
Hytrel 4047 by Toray-duPont K.K.
PEBAX 3533 by Toray K.K.
Himilan 1706 by Du Pont-Mitsui Polychemicals Co., Ltd.
Surlyn 8120 by E. I. duPont

TABLE 3

| | Cover Composition (pbw) | | | | | | |
|---|---|---|---|---|---|---|---|
| | Shore D | A | B | C | D | E | F |
| Himilan 1605 | 63 | — | — | 50 | — | — | — |
| Himilan 1706 | 63 | 55 | 85 | 50 | 70 | — | 40 |
| Surlyn 8120 | 45 | 45 | 15 | — | 30 | 100 | 60 |
| Titanium dioxide | — | 5.13 | 5.13 | 5.13 | 5.13 | 5.13 | 5.13 |

Note:
Himilan 1605 and 1706 by Du Pont-Mitsui Polychemicals Co., Ltd.
Surlyn 8120 by E. I. duPont

TABLE 4

| | | E1 | E2 | E3 | E4 | ES | CE1 | CE2 | CE3 | CE4 |
|---|---|---|---|---|---|---|---|---|---|---|
| Core | Weight (g) | 27.52 | 28.75 | 28.27 | 27.94 | 27.13 | 30.25 | 27.47 | 29.72 | 30.76 |
| | Outer diameter (mm) | 36.00 | 36.00 | 36.00 | 36.00 | 35.30 | 36.40 | 35.30 | 36.50 | 36.50 |
| | Deflection under 10–130 kg (mm) | 5.20 | 3.90 | 3.60 | 6.00 | 4.50 | 3.00 | 4.00 | 2.90 | 2.90 |
| | Surface hardness HS (Shore D) | 42 | 49 | 51 | 37 | 46 | 54 | 48 | 55 | 55 |
| | Specific gravity | 1.127 | 1.177 | 1.157 | 1.144 | 1.178 | 1.198 | 1.193 | 1.167 | 1.208 |
| Inter-mediate layer | Type | a | b | c | d | b | e | f | f | g |
| | Hardness Hm (Shore D) | 43 | 50 | 53 | 40 | 50 | 42 | 40 | 40 | 56 |
| | Weight (g) | 37.86 | 35.61 | 35.61 | 37.86 | 35.61 | 38.59 | 35.66 | 37.90 | 37.90 |
| | Outer diameter* (mm) | 39.70 | 38.70 | 38.70 | 39.70 | 38.70 | 40.00 | 38.70 | 39.70 | 39.70 |
| | Specific gravity | 1.24 | 1.16 | 1.24 | 1.19 | 1.16 | 1.01 | 1.12 | 1.12 | 0.98 |
| | Gage (mm) | 1.85 | 1.35 | 1.35 | 1.85 | 1.70 | 1.80 | 1.70 | 1.60 | 1.60 |
| Cover | Type | A | B | C | D | C | E | C | F | D |
| | Specific gravity | 0.98 | 0.98 | 0.98 | 0.98 | 0.98 | 0.98 | 0.98 | 0.98 | 0.98 |
| | Gage (mm) | 1.50 | 2.00 | 2.00 | 1.50 | 2.00 | 1.35 | 2.00 | 1.50 | 1.50 |
| | Hardness Hc (Shore D) | 55 | 60 | 63 | 58 | 63 | 45 | 63 | 53 | 58 |
| Ball | Weight (g) | 45.3 | 45.3 | 45.3 | 45.3 | 45.3 | 45.3 | 45.3 | 45.3 | 45.3 |
| | Outer diameter | | | | | | | | | |

TABLE 4-continued

| | | E1 | E2 | E3 | E4 | ES | CE1 | CE2 | CE3 | CE4 |
|---|---|---|---|---|---|---|---|---|---|---|
| | (mm) | 42.7 | 42.7 | 42.7 | 42.7 | 42.7 | 42.7 | 42.7 | 42.7 | 42.7 |
| Hm/Hs | | 1.03 | 1.02 | 1.08 | 1.05 | 1.10 | 0.78 | 0.83 | 0.73 | 1.03 |
| Hc/Hm | | 1.28 | 1.20 | 1.19 | 1.45 | 1.26 | 1.07 | 1.58 | 1.33 | 1.04 |
| w#1/HS45 | Carry (m) | 209.2 | 209.0 | 208.8 | 209.2 | 209.0 | 205.3 | 207.9 | 205.8 | 207.9 |
| | Total (m) | 222.7 | 223.0 | 223.5 | 222.6 | 223.3 | 217.5 | 221.0 | 218.1 | 219.2 |
| | Spin (rpm) | 2829 | 2613 | 2492 | 2840 | 2476 | 3001 | 2548 | 2898 | 2689 |
| | Feeling | ○ | ○ | ○ | ○ | ○ | Δ | ○ | Δ | ○ |
| I#9/HS36 | Spin (rpm) | 8942 | 8918 | 8852 | 8838 | 8823 | 9343 | 8335 | 8935 | 8566 |
| | Feeling | ○ | ○ | ○ | ○ | ○ | Δ | ○ | ○ | ○ |
| Scraping resistance | | ○ | ○ | ○ | ○ | ○ | Δ | ○ | Δ | Δ |
| Consecutive durability | | ○ | ○ | ○ | ○ | ○ | ○ | Δ | ○ | ○ |

* core + intermediate layer

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multi-piece solid golf ball comprising a solid core, an intermediate layer, and a cover, wherein the core at its surface has a Shore D hardness Hs of less than 55, the intermediate layer has a Shore D hardness Hm, and the cover has a Shore D hardness Hc, the ratio in Shore D hardness of the intermediate layer to the core surface, Hm/Hs, is from more than 1.0 to less than 1.4, and the ratio in Shore D hardness of the cover to the intermediate layer, Hc/Hm, is from more than 1.0 to less than 2.0, and the intermediate layer is formed mainly of a polyurethane resin.

2. The golf ball of claim 1 wherein said intermediate layer has a gage of 0.2 to 3 mm and a specific gravity of at least 1.08.

3. The golf ball of claim 1 wherein said cover is formed mainly of an ionomer resin and has a Shore D hardness Hc of up to 68.

4. The golf ball of claim 1 wherein said cover has a gage of 0.5 to 3.2 mm and a specific gravity of 0.9 to less than 1.2.

5. The golf ball of claim 1 wherein said solid core is formed of a rubber composition based on cis-1,4-polybutadiene and has a diameter of 32 to 41 mm.

6. The golf ball of claim 1 wherein said intermediate layer and said cover have a total gage of at least 2 mm.

7. The golf ball of claim 1 further comprising an adhesive layer between said cover and said intermediate layer.

8. The golf ball of claim 7, wherein said adhesive layer is in the range of 5 to 300 $\mu$m thick.

9. The golf ball of claim 1, wherein said core has a weight of 27 to 41 g.

10. The golf ball of claim 1, wherein said intermediate layer formed mainly of the polyurethane resin further includes at least one resin selected from polyamide elastomers, polyester elastomers, ionomer resins, styrene block elastomers, hydrogenated polybutadiene, ethylene-vinyl acetate (EVA) copolymers, polycarbonates and polyacrylates.

11. The golf ball of claim 1, wherein said intermediate layer has a specific gravity of 1.2 to 1.6.

12. The golf ball of claim 1, wherein said cover has a Shore D hardness of 50 to 67.

13. The golf ball of claim 1, wherein said core has a hardness corresponding to a deflection of 2.3 to 6.5 mm under an applied load of 100 kg.

14. The golf ball of claim 1, wherein said core has at least a hardness corresponding to a deflection of 4.5 mm under an applied load of 100 kg.

15. The golf ball of claim 1, wherein said cover has a Shore D hardness in the range of 55 to 65.

16. The golf ball of claim 1, wherein said intermediate layer has a gage in the range of 0.5 to 2.5 mm.

17. The golf ball of claim 1, wherein said cover has a gage in the range of 1.2 to 2.2 mm.

18. The golf ball of claim 1, wherein the thickness of the intermediate layer and the cover combined is in the range of 2.5 to 5.5 mm.

19. The golf ball of claim 1, wherein the golf ball has a moment of inertia of 8.2 to 8.5 g•cm$^2$.

20. The golf ball of claim 1, wherein:

$$1.0<Hc/Hm<2.0.$$

* * * * *